US007159571B2

(12) United States Patent
Kassner

(10) Patent No.: US 7,159,571 B2
(45) Date of Patent: Jan. 9, 2007

(54) METHOD FOR DETECTING REVERSE ROTATION FOR INTERNAL COMBUSTION ENGINES

(75) Inventor: Uwe Kassner, Moeglingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/240,433

(22) Filed: Sep. 30, 2005

(65) Prior Publication Data

US 2006/0162701 A1 Jul. 27, 2006

(30) Foreign Application Priority Data

Oct. 2, 2004 (DE) ..... 10 2004 048 132

(51) Int. Cl.
*F02P 11/00* (2006.01)
*F02D 41/22* (2006.01)

(52) U.S. Cl. ..... 123/479; 123/631; 123/491

(58) Field of Classification Search ..... 123/491, 123/479, 603, 631; 73/117.3, 118.1
See application file for complete search history.

(56) References Cited

U.S. PATENT DOCUMENTS

| | | | | |
|---|---|---|---|---|
| 4,181,884 | A * | 1/1980 | Shirasaki et al. | 324/207.25 |
| 4,385,605 | A * | 5/1983 | Petrie et al. | 123/406.61 |
| 4,796,208 | A * | 1/1989 | Kumagai et al. | 123/406.61 |
| 4,870,587 | A * | 9/1989 | Kumagai | 701/110 |
| 4,907,178 | A * | 3/1990 | Ogawa et al. | 702/151 |
| 5,079,945 | A | 1/1992 | Hansen et al. | |
| 5,614,821 | A * | 3/1997 | Leiderer | 324/174 |
| 5,782,210 | A * | 7/1998 | Venturoli et al. | 123/41 E |
| 5,869,962 | A * | 2/1999 | Kasumi et al. | 324/207.21 |
| 6,032,649 | A * | 3/2000 | Ono | 123/406.58 |
| 6,192,861 | B1 * | 2/2001 | Hamada et al. | 123/406.61 |
| 6,242,905 | B1 * | 6/2001 | Draxelmayr | 324/165 |
| 6,291,989 | B1 * | 9/2001 | Schroeder | 324/207.21 |
| 6,310,474 | B1 * | 10/2001 | Schroeder | 324/207.25 |
| 6,346,808 | B1 * | 2/2002 | Schroeder | 324/207.21 |
| 6,404,188 | B1 * | 6/2002 | Ricks | 324/207.22 |
| 6,566,867 | B1 * | 5/2003 | Schroeder et al. | 324/207.22 |
| 6,639,399 | B1 * | 10/2003 | Schroeder et al. | 324/207.25 |
| 6,684,687 | B1 * | 2/2004 | Frojdh | 73/117.3 |
| 6,691,690 | B1 | 2/2004 | Shin | |
| 6,694,949 | B1 * | 2/2004 | Ohira et al. | 123/406.58 |
| 6,732,713 | B1 * | 5/2004 | Kanazawa et al. | 123/476 |
| 6,752,009 | B1 * | 6/2004 | Minich et al. | 73/117.3 |
| 7,009,384 | B1 * | 3/2006 | Heremans et al. | 324/165 |
| 2006/0142927 | A1 * | 6/2006 | Kassner | 701/112 |

FOREIGN PATENT DOCUMENTS

| | | |
|---|---|---|
| DE | 19933844 | 1/2001 |
| DE | 19933845 | 1/2001 |
| JP | 2000136737 | 5/2000 |

* cited by examiner

*Primary Examiner*—Hai Huynh
(74) *Attorney, Agent, or Firm*—Kenyon & Kenyon LLP

(57) ABSTRACT

In a method for detecting reverse rotation when starting an internal combustion engine having a sensor disk which is coupled to a crankshaft of the engine, the sensor disk having a marking via an alternating arrangement of teeth and tooth spaces, and a first sensor and a second sensor each capable of generating an electric signal which may assume at least two signal levels, being associated with the sensor disk, one of the signal levels being associated with a tooth and the other signal level with a tooth space, a rising or falling signal edge of the one signal and the signal level of the other signal being used for determining the direction of rotation and increment of the angle of rotation of the crankshaft, the start characteristics are improved by determining the direction of rotation during the start of the engine as early as at the first signal edge.

7 Claims, 3 Drawing Sheets

METHOD FOR DETECTING REVERSE ROTATION FOR INTERNAL COMBUSTION ENGINES

FIELD OF THE INVENTION

The present invention relates to a method for detecting reverse rotation at the start of an internal combustion engine having a sensor disk which is coupled to a crankshaft of the engine, the sensor disk having a marking via an alternating arrangement of teeth and tooth spaces, and a first sensor and a second sensor being associated with the sensor disk, each being capable of generating an electric signal which may assume at least two levels, one signal level being associated with a tooth and the other with a tooth space, a rising or falling signal edge of one signal and the signal level of the other signal being used for determining the direction of rotation and increment of the rotational angle of the crankshaft, as well as to a control unit for carrying out the method.

BACKGROUND INFORMATION

One problem when starting the engine is an undesirable reverse rotation of the crankshaft. Typical reasons for reverse rotation may be the movement of the vehicle with an engaged gear on a slope or a premature disconnect of the starter, in which case the stored energy of the compressed cylinder acts as a gas spring, rotating the engine in reverse. Once the engine rotates in reverse, if the reverse rotation is not detected, the correct assignment of injection and ignition for the engine controller is disrupted, causing the engine to rotate in reverse for a certain time.

The basic problem is that sampling of the crankshaft signal generated by an increment wheel having an inductive or magnetoresistive sensor does not include any direction of rotation information.

Different approaches for solving this problem are known from the related art:

U.S. Pat. No. 6,691,690 describes a method for detecting reverse rotation of an internal combustion engine having a crankshaft sensor and a camshaft sensor from the relationship between the crankshaft signal and the camshaft signal.

German Patent No. DE 19933844 describes a method for determining possible reverse rotation by analyzing the time of successive tooth increments.

Japanese Patent No. JP 2000136737 describes a method for establishing a relationship between the intake manifold pressure curve and the markings on the crankshaft and/or camshaft, and U.S. Pat. No. 5,079,945 describes the analysis of two crankshaft signals using two sensor wheels and thus two sensors.

Finally, as known from German Patent No. DE 19933845, an angle sensor measuring absolute values may be provided on the camshaft.

All known methods have considerable disadvantages. Thus, methods should be adapted to the engine using careful plausibility analysis of the signals taking into account different operating conditions to provide reliable results. Methods involving additional sensors on the crankshaft or camshaft are costly and require substantial modifications of the engine design. An object of the present invention is to achieve improved reverse rotation detection at the start of an internal combustion engine using incremental sensors.

SUMMARY OF THE INVENTION

The above-mentioned disadvantages of the related art are eliminated by a method for detecting reverse rotation at the start of an internal combustion engine having a sensor disk which is coupled to a crankshaft of the engine, the sensor disk having a marking via an alternating arrangement of teeth and tooth spaces, and a first sensor and a second sensor being associated with the sensor disk, each being capable of generating an electric signal which may assume at least two levels, one signal level being associated with a tooth and the other with a tooth space, and a rising or falling signal edge of the first signal and the signal level of the second signal being used for determining the direction of rotation and increment of the rotational angle of the crankshaft, the direction of rotation of the crankshaft being determined during the start of the engine as early as at the first signal edge. Tooth and tooth space are also understood. here as the alternating arrangement of markings, for example, of magnetic or optical markings.

At the signal edge of one of the sensors (change in the signal level from high to low or from low to high), the signal level of the other sensor is determined and the direction of rotation of the crankshaft is read from an assignment table.

In a preferred embodiment of the method, reverse rotation of the crankshaft is detected if the direction of rotation of the crankshaft changes at two successive signal edges. The change in the direction of rotation results directly from the analysis of only one rising or falling edge of one of the signals. In other words, a direction of rotation may be directly associated with each edge change without analyzing previous or subsequent edges.

In the event of reverse rotation of the crankshaft, the injection and/or ignition is/are preferably suppressed, preventing the engine from rotating in reverse. In addition, in the event of reverse rotation of the crankshaft, injection and/or ignition may remain suppressed until the crankshaft attains a minimum rotational speed in the forward direction of rotation.

In the event of a signal level change of one of the sensors, a counter in the control unit for the crankshaft angle is preferably incremented or decremented as a function of the direction of rotation. The absolute crankshaft angle is thus known at all times. The instantaneous crankshaft speed may be additionally determined from these values by determining the tooth time between two edges.

The above-mentioned object is also achieved by a control unit for an internal combustion engine having a sensor disk which is coupled to a crankshaft, the sensor disk having a marking via an alternating arrangement of teeth and tooth spaces, two sensors associated with the sensor disk generating an electric signal which may assume at least two signal levels, one of the signal levels being associated with a tooth and the second signal level being associated with a tooth space, and a rising or falling signal edge of the first signal and the signal level of the second signal being used for determining the direction of rotation and increment of the rotational angle of the crankshaft, and being able to carry out the method according to the present invention.

DETAILED DESCRIPTION

Figure 1:
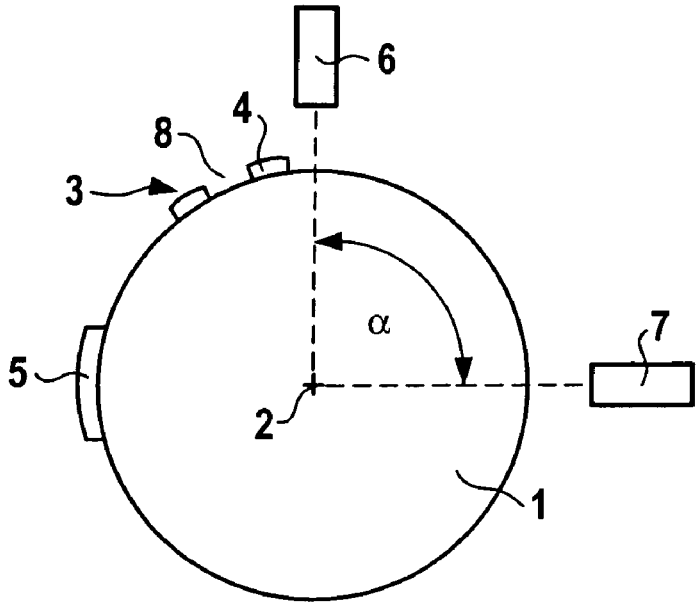
FIG. 1 shows a schematic drawing of the sensor disk and sensors.

FIG. 1 shows a schematic drawing of a sensor disk 1, which is situated directly on a crankshaft or camshaft, for example, or is indirectly connected to the camshaft with the aid of transmission elements for rotation. Sensor disk 1 rotates about an axis 2. Markings 3 are situated on the outer periphery of sensor disk 1. The markings include, for example, teeth 4, which are situated equidistant over the outer periphery of sensor disk 1. Tooth spaces 8 are situated between teeth 4. An additional marking 5, for example, as shown here in the form of a tooth 4 having double the width or in the form of a larger tooth space between two teeth 4 or the like marks an established zero position of the crankshaft. Each tooth extends over an angle of approximately 3°; each tooth space extends over an angle of 3°. Therefore, tooth 4 and the adjacent tooth space 8 extend over an angle of approximately 6°.

A first sensor 6 and a second sensor 7 are situated on sensor disk 1. Sensors 6, 7 are situated at an angle $\alpha$ relative to one another distributed in the different angle ranges over sensor disk 1. Both sensors 6, 7 are preferably situated in a shared housing. In this case, angle $\alpha$ may preferably assume values from approximately 1° to 15°. A particularly advantageous approach is a sensor having at least two sensor elements situated in the proximity of each other. One embodiment is the integration of at least two Hall elements on an IC at a distance of a few millimeters, the IC additionally containing the analyzing circuit. The two Hall elements then correspond to sensors 6 and 7, and the analyzing circuit determines the direction of rotation from the time relationship between the sensor signals. The shape of the known crankshaft sensor may then be preserved, making it possible to adopt this sensor without design changes in the engine.

When the crankshaft and thus sensor disk 1 rotate, teeth 4 and marking 5 pass by sensors 6, 7, triggering an electric signal in sensors 6, 7, for example. Sensors 6, 7 may be inductive or capacitive sensors. Alternatively, sensors 6, 7 may also be optical sensors, for example, being able to measure the optical changes caused in them by teeth 4 or marking 5.

Figure 2:
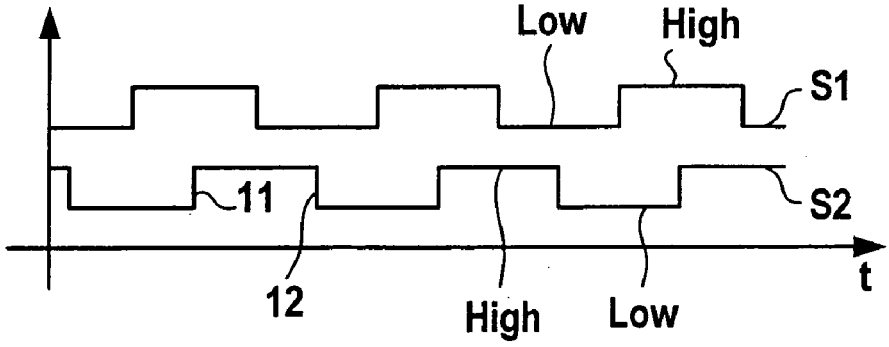
FIG. 2 shows a first example of the sensor signal curve.

FIG. 2 shows the signal curve of sensors 6, 7 over time t. The alternating passage of teeth 4 and tooth spaces 8 generates a square signal both in signal curve S1 of first sensor 6 and in signal curve S2 of second sensor 7. Both signals assume the value "high" or "low." The transition from low to high is identified as rising edge 11, and the transition from high to low is identified as falling edge 12.

The schematic drawing in FIG. 2 shows which edges are being analyzed. Tables 1 and 2 show the assignment for determining the direction of rotation.

Rising signal edge 11 is identified in the following tables 1 and 2 as "L->H". Falling edge 12 is identified as "H->L." DR denotes the direction of rotation of the crankshaft, -> denoting counterclockwise rotation, and <- denoting clockwise rotation.

TABLE 1

| S1 | S2 | DR |
|---|---|---|
| H->L | L | -> |
| L->H | H | -> |
| H | H->L | -> |
| L | L->H | -> |

TABLE 2

| S1 | S2 | DR |
|---|---|---|
| H->L | H | <- |
| L->H | L | <- |
| L | H->L | <- |
| H | L->H | <- |

During the rising or falling edge of signal S1 or S2, the direction of rotation of the crankshaft may be determined from the other signal which is then constant. For example, if the edge of signal S1 (H->L) is failing and signal S2 is on the high level, the crankshaft is rotating counterclockwise.

Figure 3:
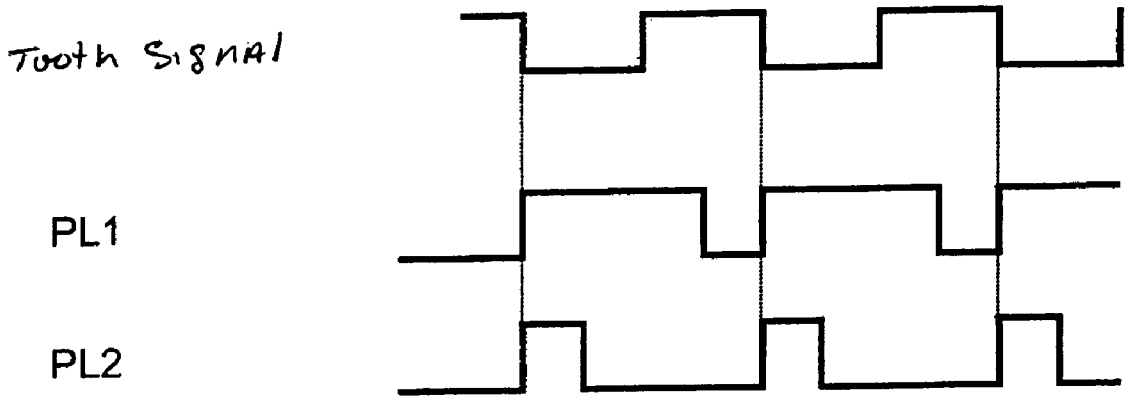
FIG. 3 shows the pulse-length-coded signals for both directions of rotation.

A signal coded according to FIG. 3 is generated from the sensor signals to make direct evaluation of the direction of rotation possible using a single signal for the engine control unit. The signal curve of one of sensors 6, 7 over time is shown, as well as two signals PL1 and PL2 over time derived therefrom. The signal of one of sensors 6, 7 initially delivered as a square signal is converted into a clock signal with direction information using Tables 1 and 2 according to FIG. 3. In the example of FIG. 3, a signal PL1 having a longer duration of the high level shows clockwise rotation, for example, and a signal generated in reverse, having a shorter duration of the high level, shows counterclockwise rotation of the crankshaft. The rising edges are also identical in time (thus with respect to the crankshaft angle) to the signal of one of sensors 6 or 7 and are used to increment or decrement a counter in the control unit for the crankshaft angle. This signal coding preferably takes place in the IC, which contains at least two Hall elements. Signals PL1 and PL2 are suitably analyzed in the control unit.

Figure 4:
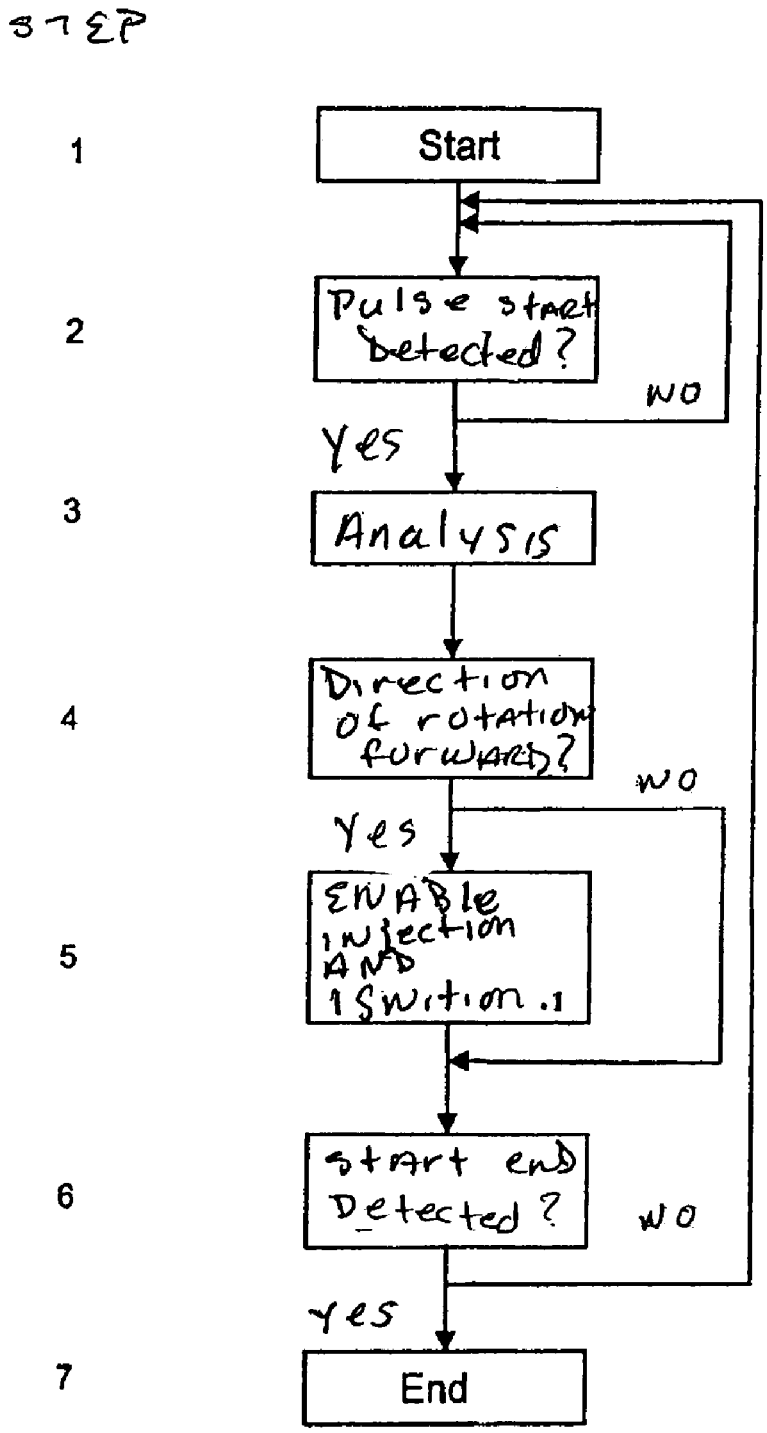
FIG. 4 shows a block diagram of the method according to the present invention.

Furthermore, according to the present invention, in an extended application of this crankshaft sensor, the direction of rotation information is analyzed immediately after engine start. The direction of rotation may be analyzed in the engine control unit as early as at the first tooth. If reverse rotation is detected, injection and ignition may be suppressed until the required forward direction of rotation of the motor is observed via the starter torque. FIG. 4 shows a block diagram of the method. The method starts in step 1, for example, with switching on of the engine electronics by turning the ignition key or, at the latest, with the start of crankshaft rotation (via the operation of the starter) when the engine is started, and a check is performed in a step 2 to determine whether a pulse start may be detected. The pulse start is the rising edge according to the above-described signal definition for PL1 and PL2. When signals S1 and S2 are transmitted to the control unit, analysis is started by an edge change of one of the signals S1 or S2 as explained above. The direction of rotation of the crankshaft is determined in steps 3 and 4 as explained above. If the crankshaft rotates in the direction of drive of the engine (the "correct" direction), ignition and injection are enabled in step 5. If the crankshaft rotates in the opposite direction (i.e., in reverse), injection and ignition are not enabled in step 5; this is represented by the branch to "no" and by skipping this step in FIG. 4. In step 6 a check is performed to determine whether the start phase of the internal combustion engine has been completed. This is the case, for example, when the crankshaft has attained sufficient speed. If the start phase has been completed, the above-described method is terminated; if the start phase has not been completed, the method branches off to the beginning of the method, i.e., step 2, and the method is run through again. Method steps 2 through 6 are preferably run through at such a high speed that the check in step 4 may take place for each individual tooth and thus for each edge change.

What is claimed is:

1. A method for detecting reverse rotation when starting an internal combustion engine, the method comprising:

providing a sensor disk which is coupled to a crankshaft of the engine, the sensor disk having a marking via an alternating arrangement of teeth and tooth spaces, and a first sensor and a second sensor each capable of generating a respective electric signal which can assume at least two signal levels, being associated with the sensor disk, one of the signal levels being associated with a tooth and the other signal level with a tooth space; and using one of a rising and falling signal edge of one of the signals and the signal level of the other signal for determining a direction of rotation and an increment of an angle of rotation of the crankshaft, wherein the direction of rotation of the crankshaft is determined during a start of the engine as early as at a first signal edge.

2. The method according to claim 1, further comprising, at a signal edge of one of the sensors, determining the signal level of the other sensor and reading the direction of rotation of the crankshaft from an assignment table.

3. The method according to claim 1, further comprising detecting reverse rotation of the crankshaft when the direction of rotation of the crankshaft changes at two successive signal edges.

4. The method according to claim 1, further comprising suppressing at least one of an injection and an ignition in the event of reverse rotation of the crankshaft.

5. The method according to claim 4, wherein the suppression is performed until the crankshaft has attained a minimum speed.

6. The method according to claim 1, further comprising, at a change in the signal level of one of the sensors, one of incrementing and decrementing a counter for the crankshaft angle as a function of the direction of rotation.

7. A control unit for an internal combustion engine, comprising:

a sensor disk which is coupled to a crankshaft, the sensor disk having a marking via am alternating arrangement of teeth and tooth spaces;

two sensors associated with the sensor disk generating respective electric signals which can assume at least two signal levels, one of the signal levels being associated with a tooth and the other signal level with a tooth space; and means for using one of a rising and falling signal edge of one of the signals and the signal level of the other signal for determining a direction of rotation and an increment of a rotation angle of the crankshaft, wherein the direction of rotation of the crankshaft is determined during a start of the engine as early as at a first signal stage.

* * * * *